US010852017B2

(12) United States Patent
Shin

(10) Patent No.: US 10,852,017 B2
(45) Date of Patent: Dec. 1, 2020

(54) AIR UMBRELLA DEVICE

(71) Applicant: Sang Ho Shin, Suwon-si (KR)

(72) Inventor: Young Cheol Shin, Gyeonggi-do (KR)

(73) Assignee: Sang Ho Shin, Suwon-si (KR)

( * ) Notice: Subject to any disclaimer, the term of this patent is extended or adjusted under 35 U.S.C. 154(b) by 792 days.

(21) Appl. No.: 15/529,291

(22) PCT Filed: Nov. 23, 2015

(86) PCT No.: PCT/KR2015/012590
§ 371 (c)(1),
(2) Date: Aug. 7, 2017

(87) PCT Pub. No.: WO2016/085215
PCT Pub. Date: Jun. 2, 2016

(65) Prior Publication Data

US 2017/0336087 A1 Nov. 23, 2017

(30) Foreign Application Priority Data

Nov. 24, 2014 (KR) ..... 10-2014-0164632
Nov. 11, 2015 (KR) ..... 10-2015-0157876

(51) Int. Cl.
*F24F 9/00* (2006.01)
*E04H 15/00* (2006.01)
(Continued)

(52) U.S. Cl.
CPC ..... *F24F 9/00* (2013.01); *E04H 1/00* (2013.01); *E04H 1/1211* (2013.01); *E04H 15/00* (2013.01); *F24F 2009/007* (2013.01)

(58) Field of Classification Search
CPC ..... F24F 9/00; F24F 2009/007; F24F 1/06; F24F 1/56; F24F 1/58; F24F 12/00;
(Continued)

(56) References Cited

U.S. PATENT DOCUMENTS 3,361,051 A * 1/1968 Fair ..... F23L 17/04 454/8
5,934,993 A * 8/1999 Maruyama ..... F24F 7/06 454/250

(Continued)

FOREIGN PATENT DOCUMENTS

JP 6-257812 A 9/1994
KR 20-1989-0005241 U 4/1989

(Continued)

*Primary Examiner* — Grant Moubry
*Assistant Examiner* — Ryan L Faulkner
(74) *Attorney, Agent, or Firm* — Vorys, Sater, Seymour & Pease LLP; Mih Suhn Koh

(57) ABSTRACT

Disclosed is an air umbrella apparatus including an air suction pipe having an air suction hole in an upper end thereof, a water collection pipe disposed concentrically with the air suction pipe and having an upper end coupled to a water-collection-inducing pipe for guiding rain or snow downward, an exhaust pipe disposed concentrically with the water collection pipe and having an upper end coupled to an exhaust-guiding pipe for guiding air outward, a communication pipe coupled to the air suction pipe, the water collection pipe, and the exhaust pipe for communicating the air suction pipe with the exhaust pipe, and a blower disposed between the exhaust pipe and the water collection pipe for the introduction and exhaust of air. The exhausted air forms an air curtain having a predetermined area above the exhaust-guiding pipe, thereby preventing rain and snow from falling from the exhaust-guiding pipe.

8 Claims, 7 Drawing Sheets

(51) Int. Cl.
*E04H 1/12* (2006.01)
*E04H 1/00* (2006.01)

(58) Field of Classification Search
CPC ..... F24F 2221/52; E04H 1/00; E04H 1/1211; E04H 15/00
USPC ..... 454/189
See application file for complete search history.

(56) References Cited

U.S. PATENT DOCUMENTS

2015/0292761 A1* 10/2015 Teoh ..... F24F 7/02
454/242
2016/0102876 A1* 4/2016 Teoh ..... F24F 13/26
454/250

FOREIGN PATENT DOCUMENTS

KR 20-2011-0004305 U 5/2011
KR 10-2014-0020101 A 2/2014
KR 10-1495681 B1 2/2015

* cited by examiner (a)

(b)

AIR UMBRELLA DEVICE

BACKGROUND OF THE INVENTION

Field of the Invention

The present invention relates to an air umbrella apparatus, and more particularly, to an air umbrella apparatus capable of protecting a predetermined area in an open space having no roof from rain or snow via the suction and ejection of air without a separate awning in the event of rain.

Description of the Related Art

In places such as, for example, a bus stop, a public building, and the outside of a restaurant, a shading apparatus is installed in order to block, for example, rain and snow. Such a shading apparatus is kept in a folded state when there is no rain or snow, and is used in an unfolded state when rain or snow falls.

An example of a conventional shading apparatus is disclosed in Korean Patent Registration No. 10-0662106, which is titled "Shading Apparatus and Manufacturing Method thereof".

Conventional shading apparatuses vary in size depending on the installation place thereof, and require a considerable cost for installation. In addition, in order to fold or unfold the shading apparatus, a user may be required to manually drive the shading apparatus, or the shading apparatus may be automatically driven using a separate drive motor. Thereby, considerable labor and costs are consumed for the driving and management of the shading apparatus.

SUMMARY OF THE INVENTION

Therefore, the present invention has been made in view of the above problems, and it is an object of the present invention to provide an air umbrella apparatus capable of protecting a predetermined area from rain or snow by forming an air curtain via the suction and ejection of air without needing to fold or unfold an awning.

The above object and various advantages of the present invention will be more apparent from exemplary embodiments of the present invention by those who skilled in the art.

In accordance with one aspect of the present invention, the above and other objects can be accomplished by the provision of an air umbrella apparatus including an air suction pipe vertically disposed on a ground and having an air suction hole formed in an upper end thereof, a water collection pipe disposed concentrically with the air suction pipe so as to accommodate the air suction pipe therein, a water-collection-inducing pipe being coupled to an upper end of the water collection pipe so as to guide rain or snow downward, an exhaust pipe disposed concentrically with the water collection pipe so as to accommodate the water collection pipe therein, an exhaust-guiding pipe being coupled to an upper end of the exhaust pipe so as to guide air outward, a communication pipe coupled to lower ends of the air suction pipe, the water collection pipe, and the exhaust pipe so as to communicate the air suction pipe and the exhaust pipe with each other, and a blower disposed between the exhaust pipe and the water collection pipe so as to introduce the air through the air suction pipe and exhaust the air through the exhaust pipe, wherein the air exhausted through the exhaust-guiding pipe forms an air curtain having a predetermined area at an upper side of the exhaust-guiding pipe, thereby preventing the rain and snow from falling from the exhaust-guiding pipe.

The air suction pipe may include a semispherical suction head coupled to the upper end thereof, and the air suction hole, into which the air is suctioned, may be formed in a plural number in a surface of the suction head.

Each of the water-collection-inducing pipe and the exhaust-guiding pipe may take the form of a tapered tube, a diameter of which gradually increases upward.

The communication pipe may be provided at a lower side thereof with a water sump in which rainwater and melted snow moved downward through the water collection pipe is stored.

The water-collection-inducing pipe may include a hot wire heater provided on a surface thereof.

The exhaust-guiding pipe may be longer than the water collection pipe, and the exhaust-guiding pipe may be configured so as to be foldable toward a center thereof.

The air umbrella apparatus may further include an inverter coupled to the blower so as to drive the blower forward or in reverse.

In accordance with another aspect of the present invention, there is provided an air umbrella apparatus including an air suction pipe vertically disposed on a ground and having an air suction hole formed in an upper end thereof, a water collection pipe disposed concentrically with the air suction pipe so as to accommodate the air suction pipe therein, a water-collection-inducing pipe being coupled to an upper end of the water collection pipe so as to guide rain or snow downward, an exhaust pipe disposed concentrically with the water collection pipe so as to accommodate the water collection pipe therein, an exhaust-guiding pipe being coupled to an upper end of the exhaust pipe so as to guide air outward, a communication pipe coupled to lower ends of the air suction pipe, the water collection pipe, and the exhaust pipe so as to communicate the air suction pipe and the exhaust pipe with each other, and an outer blower installed under a ground and connected to the exhaust pipe via a blower pipe so as to introduce the air through the air suction pipe and exhaust the air through the exhaust pipe, wherein the air exhausted through the exhaust-guiding pipe forms an air curtain having a predetermined area at an upper side of the exhaust-guiding pipe, thereby preventing the rain and snow from falling from the exhaust-guiding pipe.

In accordance with a further aspect of the present invention, there is provided an air umbrella apparatus including an air suction pipe vertically disposed on a ground and having a suction hole formed in an upper end thereof, into which outside air is suctioned, a water collection pipe disposed concentrically with the air suction pipe so as to accommodate the air suction pipe therein, a water-collection-inducing pipe being coupled to an upper end of the water collection pipe so as to guide rain or snow inward, an exhaust pipe disposed concentrically with the water collection pipe so as to accommodate the water collection pipe therein, an exhaust-guiding pipe being coupled to an upper end of the exhaust pipe so as to guide inside air outward, a communication pipe accommodated inside the water collection pipe and coupled to a lower end of the air suction pipe so as to move the outside air that has passed through the air suction pipe to a space between the water collection pipe and the exhaust pipe, a blower rotatably provided at a lower side of the exhaust pipe so as to form an air stream so that the outside air is introduced through the air suction pipe, and thereafter the inside air is exhausted through the exhaust-guiding pipe, and an air guiding unit disposed between the blower and the water collection pipe and configured to guide the inside air that has passed through the blower to a space between the exhaust-guiding pipe and the water-collection-inducing pipe, wherein the inside air exhausted through the exhaust-guiding pipe forms an air curtain having a predetermined area at an upper side of the exhaust-guiding pipe, thereby preventing the rain and snow from falling from the exhaust-guiding pipe.

The air umbrella apparatus may further include a dehumidification unit provided between a bottom surface of the exhaust pipe and the blower and configured to remove moisture contained in the outside air introduced into the exhaust pipe.

The air guiding unit may include a housing configured to cover a top of the blower, a plurality of air guiding pipes disposed in an upper region of the housing at a constant interval and configured so as to extend to the space between the water-collection-inducing pipe and the exhaust-guiding pipe, and an exhaust ring coupled so as to communicate with the air guiding pipes and disposed in a ring shape between the water-collection-inducing pipe and the exhaust-guiding pipe so as to discharge the inside air moved along the air guiding pipes.

The air umbrella apparatus may further include a water sump connection pipe configured to extend from a lower end of the water collection pipe to an outside of the exhaust pipe so as to discharge the rain or water outward.

The air umbrella apparatus may further include a dehumidification drain pipe configured to extend outward from the dehumidification unit so as to outwardly discharge water absorbed and condensed by the dehumidification unit.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF REFERENCE NUMERALS

Figure 1:
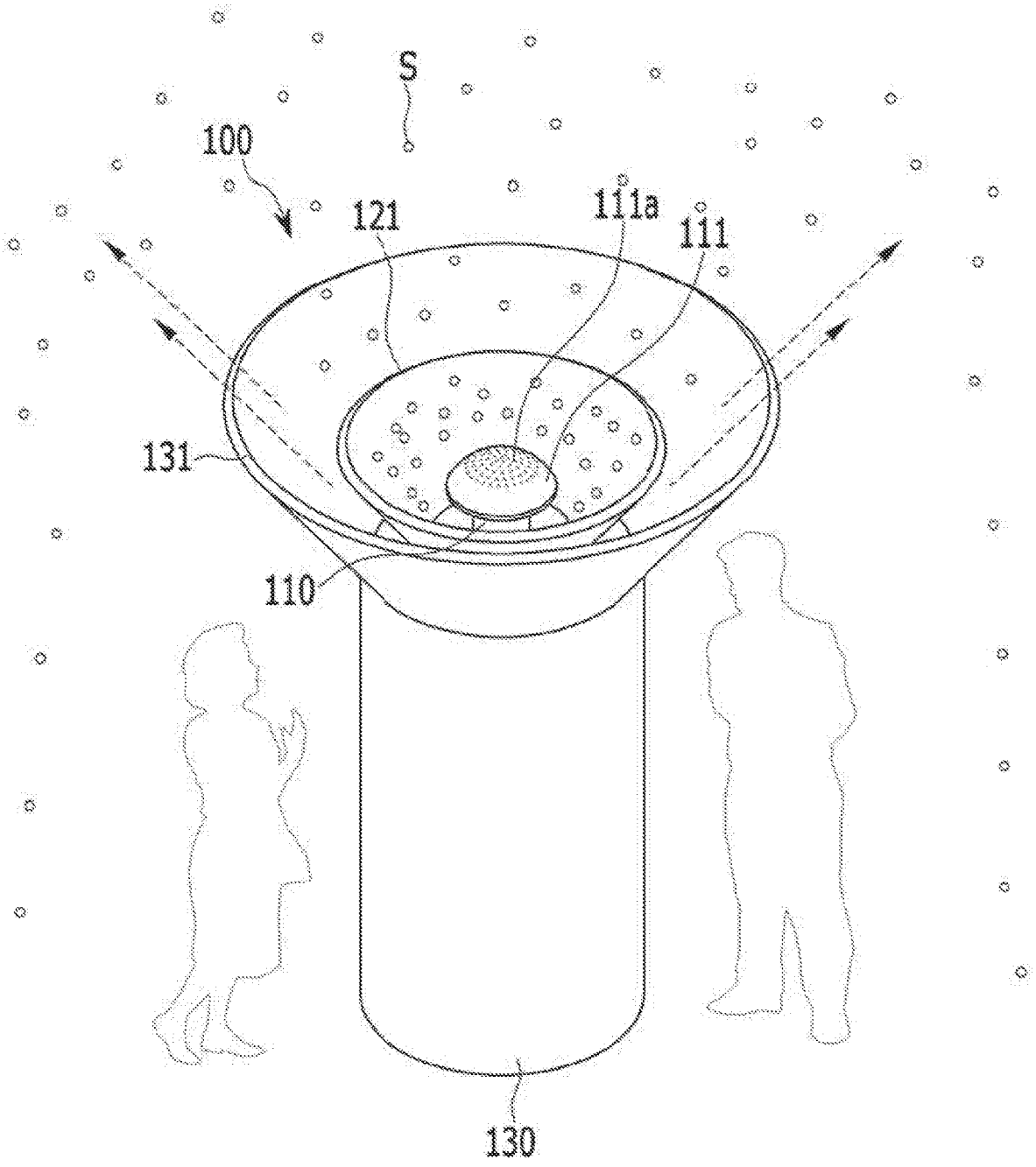
FIG. 1 is a perspective view illustrating the state in which an air umbrella apparatus according to an exemplary embodiment of the present invention is installed.

100: air umbrella apparatus
110: air suction pipe
111: suction head
111*a*: suction hole
120: water collection pipe
121: water-collection-inducing pipe
123: first opening
125: hot wire heater
130: exhaust pipe
131: exhaust-guiding pipe
140: communication pipe
141: communication pipe body
143: suction pipe connection hole
145: air movement pipe
145*a*: exhaust pipe connection hole
150: blower
151: rotational blade
160: water sump
170: outer blower
200: air umbrella
210: air suction pipe
211: suction head
211*a*: suction hole
220: water collection pipe
221: water-collection-inducing pipe
223: lower inclined portion
225: outer drain pipe
225*a*: water sump connection pipe
227: air discharge hole
230: exhaust pipe
231: exhaust-guiding pipe
233: drain pipe exposing hole
240: communication pipe
241: communication pipe body
243: suction pipe connection hole
245: air movement pipe
250: dehumidification unit
251: dehumidification exhaust pipe
260: blower
261: rotational blade
265: fan drive unit
270: air guiding unit
271: housing
273: air guiding pipe
275: exhaust ring
280: water sump
A: inside air
B: outside air
C: rainwater and melted snow
S: snow

DETAILED DESCRIPTION OF THE INVENTION

To assist sufficient understanding of the present invention, exemplary embodiments of the present invention will be described below with reference to the accompanying drawings. The embodiments of the present invention may be altered in various ways, and the scope of the present invention should not be construed to be limited to the embodiments of the present invention, which are described below in detail. The embodiments are provided to more completely explain the present invention to one of ordinary skill in the art. Thus, the shape and the like of elements may be exaggerated in order to clarify the description. It should be noted that the same reference numbers will be used throughout the drawings to refer to the same or like parts. A detailed description of known functions or configurations incorporated herein will be omitted when it may make the subject matter of the disclosure rather unclear.

Figure 2:
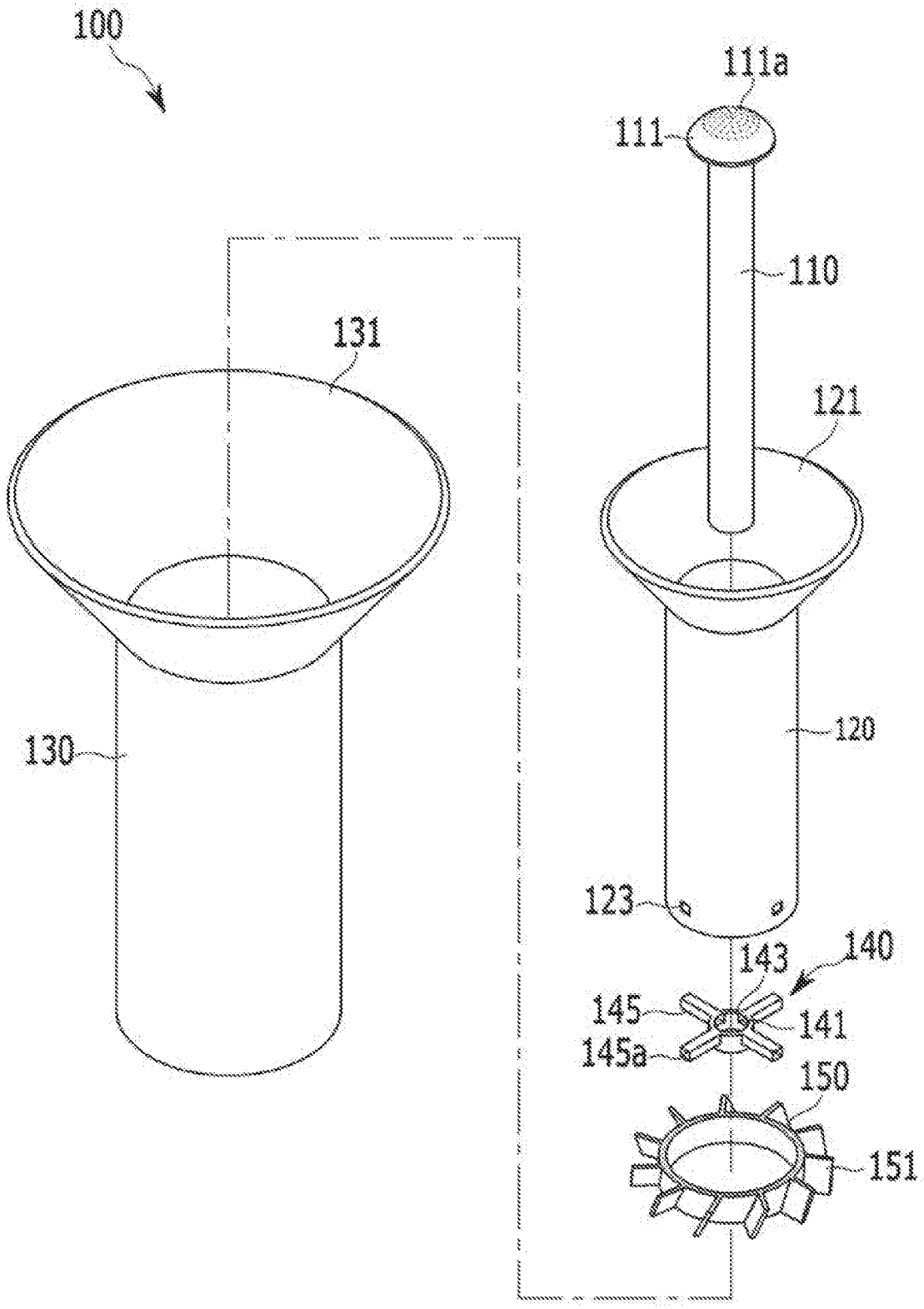
FIG. 2 is an exploded perspective view illustrating the configuration of the air umbrella apparatus according to the exemplary embodiment of the present invention.
Figure 3:
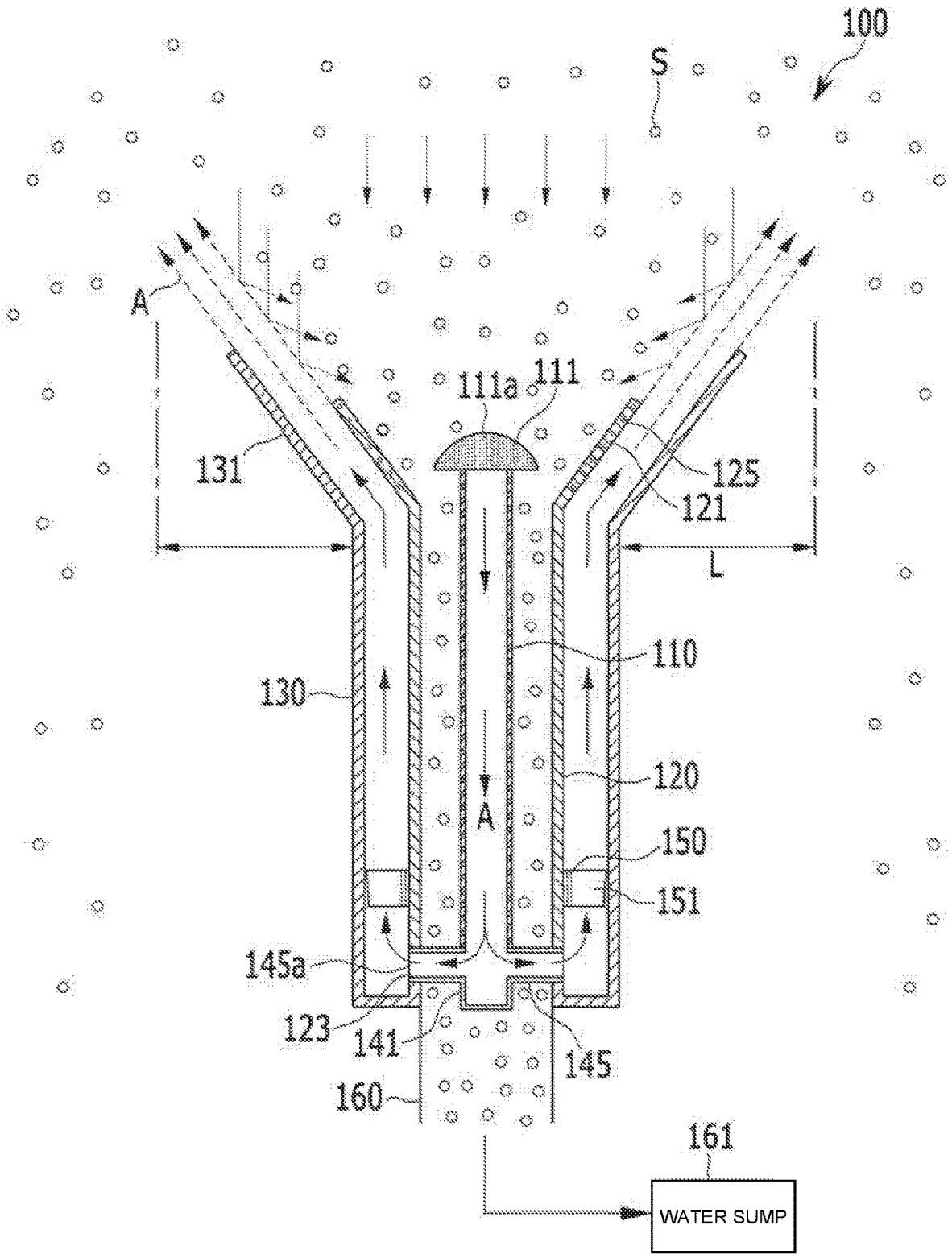
FIG. 3 is a cross-sectional view illustrating the operating procedure of the air umbrella apparatus according to the exemplary embodiment of the present invention.

FIG. 1 is a perspective view illustrating the state in which an air umbrella apparatus 100 according to an exemplary embodiment of the present invention is installed to block snow S, FIG. 2 is an exploded perspective view illustrating the configuration of the air umbrella apparatus 100 according to the exemplary embodiment of the present invention, and FIG. 3 is a cross-sectional view illustrating the operating procedure of the air umbrella apparatus 100.

As illustrated, in the air umbrella apparatus 100 according to the exemplary embodiment of the present invention, an air suction pipe 110, a water collection pipe 120, and an exhaust pipe 130 are concentrically superimposed one above another. The air suction pipe 110 is centrally disposed, the water collection pipe 120 is disposed so as to accommodate the air suction pipe 110 therein, and the exhaust pipe 130 is disposed outside the air suction pipe 110. The air suction pipe 110 and the exhaust pipe 130 are interconnected so as to communicate with each other at the lower ends thereof via a communication pipe 140.

The air suction pipe 110 is vertically oriented and has a predetermined height from the ground. The air suction pipe 110 is provided at the upper end thereof with a suction head 111 for suctioning air. The suction head 111 has a spherical shape or a semispherical shape. The suction head 111 is provided with a plurality of suction holes 111*a* formed in the surface thereof for suctioning air.

The air introduced into the suction head 111 passes through the air suction pipe 110 to thereby be discharged to the atmosphere through the exhaust pipe 130. The air suction pipe 110 and the suction head 111 may be integrally formed with each other, or may be separably coupled to each other.

The water collection pipe 120 has a greater diameter than the air suction pipe 110. The water collection pipe 120 is disposed so as to accommodate the air suction pipe 110 therein. The water collection pipe 120 is vertically coupled to the upper end of the communication pipe 140. The water collection pipe 120 is provided at the upper end thereof with a water-collection-inducing pipe 121, which takes the form of a tapered tube, the diameter of which gradually increases upward.

The water-collection-inducing pipe 121 guides rain or snow to the water collection pipe 120. The rain or snow is introduced into the water collection pipe 120 along the inclined surface of the water-collection-inducing pipe 121. The rain or snow introduced into the water collection pipe 120 moves downward through the communication pipe 140, and thereafter moves to a water sump 160.

Here, a hot wire heater 125 may be mounted in the water-collection-inducing pipe 121. Thereby, it is possible to prevent snow accumulated on the surface of the water-collection-inducing pipe 121 from being frozen and blocking the movement path of snow in winter. That is, in winter, the hot wire heater 125 may be driven so that the snow melts on the surface of the water-collection-inducing pipe 121 and moves down to the water collection pipe 120.

The exhaust pipe 130 is disposed outside the water-collection-inducing pipe 121. The exhaust pipe 130 is provided at the upper end thereof with an exhaust-guiding pipe 131, which takes the form of a tapered tube to guide the discharge of air.

The exhaust pipe 130 discharges the air that has moved through the communication pipe 140 to the atmosphere so as to form an air curtain having a predetermined thickness. When the air curtain prevents rain or snow from moving downward, a shield region L, which is protected from snow and rain, may be formed below the exhaust-guiding pipe 131.

Here, the exhaust-guiding pipe 131 may be longer than the water-collection-inducing pipe 121, in order to increase the length of the air curtain.

The water collection pipe 120 and the exhaust pipe 130 may be formed of a synthetic resin, such as a plastic, or a metal material.

The communication pipe 140 couples the air suction pipe 110, the water collection pipe 120, and the exhaust pipe 130 to one another, and forms an air movement path so that the air introduced into the air suction pipe 110 is discharged to the exhaust pipe 130.

As illustrated in FIG. 3, the communication pipe 140 includes a communication pipe body 141, which is disposed coaxially with the air suction pipe 110, and an air movement pipe 145, which extends from the communication pipe body 141 in opposite directions so as to be inserted through the water collection pipe 120.

The communication pipe body 141 has the same diameter as the air suction pipe 110. A suction pipe connection hole 143 is formed through the communication pipe body 141. The communication pipe body 141 is disposed coaxially with the air suction pipe 110 so that the air introduced into the air suction pipe 110 is introduced into the suction pipe connection hole 143. The communication pipe body 141 has a blind lower end so as to allow all of the introduced air to move to the air movement pipe 145.

The air movement pipe 145 extends from the side surface of the communication pipe body 141 so as to be inserted through the lower portion of the water collection pipe 120. A first opening 123 is formed in the lower portion of the water collection pipe 120.

The air movement pipe 145 is inserted into the first opening 123 and transports the air to the exhaust pipe 130. Here, the end of the air movement pipe 145 is provided with an exhaust pipe connection hole 145*a* for supplying the air to the exhaust pipe 130.

A blower 150 is fitted in the space between the exhaust pipe 130 and the water collection pipe 120, and applies drive force so as to forcibly move the air. The blower 150 takes the form of a ring that surrounds the outer circumferential surface of the water collection pipe 120, and is provided with a plurality of rotational blades 151 in the circumferential direction thereof.

Although not illustrated in the drawings, a bearing (not illustrated) is provided between the water collection pipe 120 and the blower 150. A rotator (not illustrated) is provided inside the blower 150, and a drive (not illustrated) is provided in the water collection pipe 120 so as to correspond to the rotator (not illustrated). When the rotator (not illustrated) rotates along with the drive (not illustrated) via the supply of power, the blower 150 is rotated about the bearing (not illustrated).

When the blower 150 is rotated, air is introduced through the air suction pipe 110 and then is discharged outward through the exhaust pipe 130, thus forming an air curtain.

Here, an inverter (not illustrated) may be additionally coupled to the blower 150. With the coupling of the inverter (not illustrated), a user may rotate the blower 150 forward or in reverse. The blower 150 may be driven forward when it is desired to form an air umbrella for blocking rain and snow, and may be driven in reverse upon initial operation in order to discharge air from the air suction pipe 110 so as to remove foreign substances from the surface of the air suction pipe 110.

The operating procedure of the air umbrella apparatus 100 according to the exemplary embodiment of the present invention having the above-described configuration will be described with reference to FIGS. 1 to 3.

For installation, the user concentrically disposes the air suction pipe 110, the water collection pipe 120, and the exhaust pipe 130, which have different diameters, and couples the communication pipe 140 to the lower ends thereof. After the air suction pipe 110 and the communication pipe body 141 are coaxially disposed, they are fixed to each other. This fixing may be performed using fastening members such as a bolt and a nut, or may be performed by welding.

Then, the air movement pipe 145 is inserted into and coupled to the first opening 123 in the water collection pipe 120.

Under the ground on which the air umbrella apparatus 100 is installed, the water sump 160 is installed to store rain and snow introduced into the water collection pipe 120.

When there is no rain or snow, the state in which no power is supplied to the blower 150 is maintained. When rain or snow suddenly starts to fall, the user supplies power to the blower 150. When the blower 150 is rotated, air is suctioned into the air suction pipe 110.

As illustrated in FIG. 3, the air A, suctioned into the suction holes 111*a* in the suction head 111, moves along the air suction pipe 110. Then, after being introduced into the communication pipe body 141, the air moves to the exhaust pipe 130 along the air movement pipe 145. The air moves upward from the exhaust pipe 130, and thereafter is obliquely discharged to the atmosphere along the exhaust-guiding pipe 131.

At this time, the air is discharged by an amount corresponding to the thickness of the space between the exhaust pipe 130 and the water collection pipe 120, thereby forming an air curtain. The rain or snow, which falls to the air curtain, is guided so as to move to the water collection pipe 120 by the pressure of the air curtain.

That is, a low-pressure suction air field is created at the upper side of the water-collection-inducing pipe 121 by the amount of air introduced through the air suction pipe. Thereby, when the rain or snow reaches the inside of the air curtain, it changes direction and moves to the inside of the low-pressure suction air field created at the upper side of the water-collection-inducing pipe 121, thereby being guided to the water collecting pipe 120 by the weight thereof. As a result, the shield region L, which is protected from exposure to rain or snow, is formed below the space that corresponds to the periphery of the air curtain, which is formed at the upper side of the exhaust pipe 130.

In this way, the shield region L, which is protected from rain or snow, is formed below the exhaust-guiding pipe 131 by which the air curtain is formed. When rain or snow falls, a pedestrian who stands below the exhaust-guiding pipe 131 may avoid rain or snow.

At this time, when the length of the air curtain is increased by increasing or reducing the rotational speed of the blower 150, the area of the shield region L may be increased. In addition, the rotational speed of the blower 150 may be increased or reduced according to the amount of rain or snow.

Meanwhile, the rain or snow introduced into the water collection pipe 120 moves downward, and thereafter is stored in the water sump 160.

The air umbrella apparatus according to the exemplary embodiment of the present invention creates the shield region, which is protected from rain and snow, using the air curtain formed via the suction and discharge of air without a separate awning. Accordingly, the air umbrella apparatus may be used to provide a shelter for spectators when rain suddenly starts to fall when it is installed in, for example, an outdoor theater, or may prevent deep snow damage when it is installed on a vinyl greenhouse or a weak roof.

In addition, when the air umbrella apparatus of the present invention is installed in the stand of a football pitch or at an urban bus stop, people may safely avoid rain or snow without using umbrellas.

In addition, since the rain and snow stored in the water sump are clean, it may be reused in a desired place.

Figure 4:
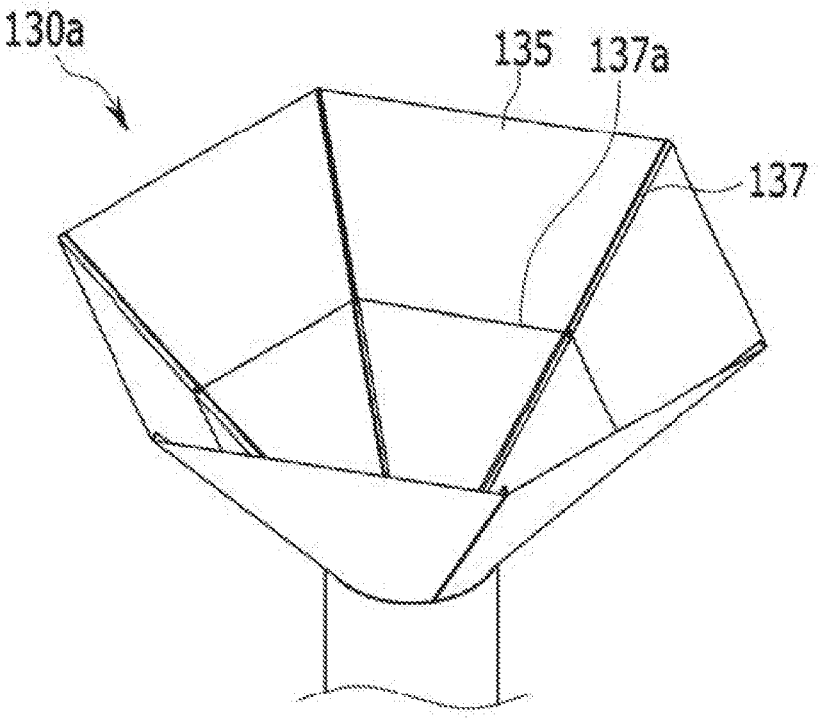
FIG. 4 is a perspective view illustrating a modification of the air umbrella apparatus according to the exemplary embodiment of the present invention.
Figure 4:
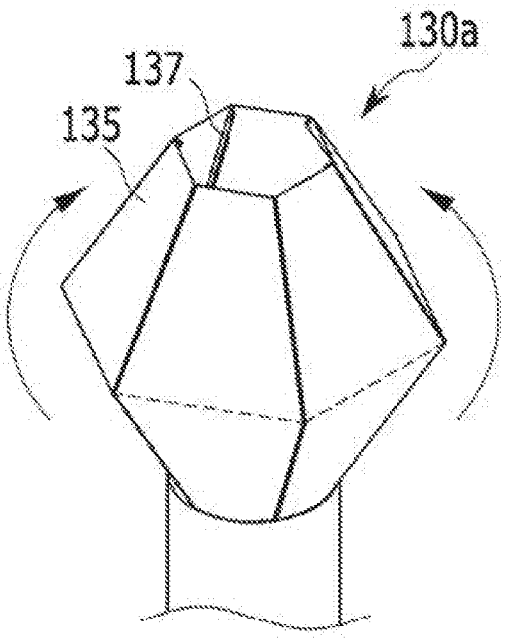

FIG. 4 is a perspective view illustrating another embodiment 130*a* of the exhaust pipe 130 of the present invention. The exhaust pipe 130 according to the above-described exemplary embodiment has a fixed shape because the exhaust pipe 130 and the exhaust-guiding pipe 131 are integrally formed with each other.

Differently, the exhaust pipe 130*a* according to another embodiment of the present invention is provided so as to be folded according to whether it is in use or not. That is, as illustrated in FIG. 4(*a*), the exhaust pipe is unfolded when it is used as an air umbrella. However, when it is not used, the upper portion of the exhaust pipe is folded as illustrated in FIG. 4(*b*). Thereby, it is possible to prevent foreign substances from being introduced into the air suction pipe 110 and the water collection pipe 120 when not in use.

To realize this foldable structure, an exhaust-guiding pipe 135 of the exhaust pipe 130*a* is formed of waterproof fibers, like an umbrella. In addition, the exhaust-guiding pipe is provided with vertical frames 137 at a constant interval and is also provided with a horizontal frame 137*a*. The vertical frames 137 are foldable inward about the horizontal frame 137*a*. That is, each vertical frame 137 is configured as upper and lower links about the horizontal frame 137*a*.

The vertical frames 137 are coupled to a hydraulic cylinder (not illustrated) having a variable length and are driven so as to be folded or unfolded according to the length of the hydraulic cylinder (not illustrated). In addition, in some cases, the horizontal frame 137*a* may be rotated by a drive motor (not illustrated) so as to allow the vertical frames 137 to be folded inward. The vertical frames 137 may, however, be folded by various other driving methods.

Figure 5:
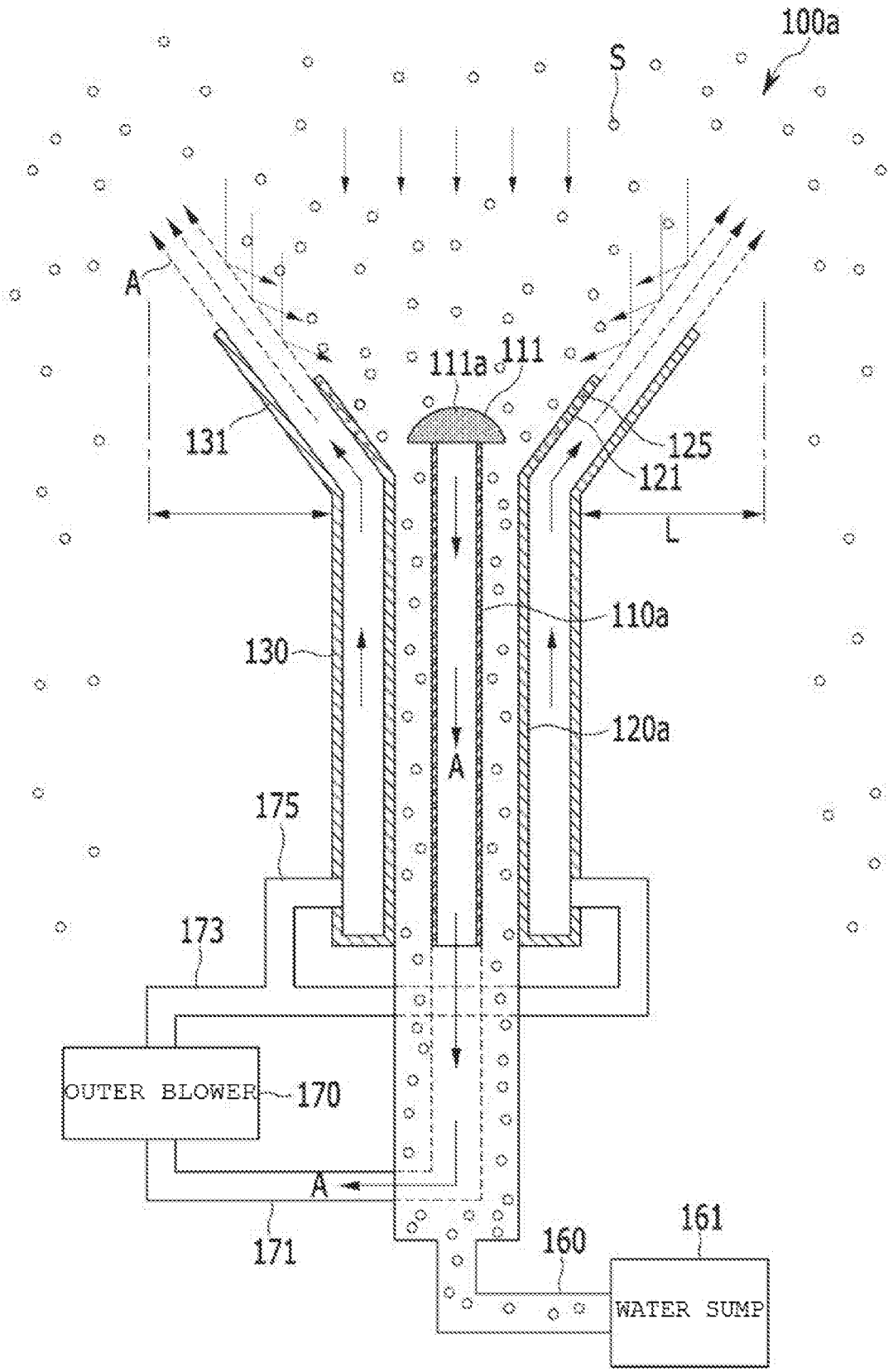
FIG. 5 is a cross-sectional view illustrating the configuration of another modification of the air umbrella apparatus according to the exemplary embodiment of the present invention.

FIG. 5 is a schematic view illustrating an air umbrella apparatus 100*a* according to a modification of the exemplary embodiment of the present invention. In the air umbrella apparatus 100 according to the above-described exemplary embodiment of the present invention, the blower 150 is provided in the space between the exhaust pipe 130 and the water collection pipe 120. In this case, the rotational blades 151 of the blower 150 may hinder the smooth flow of air to be transported.

Differently, in the air umbrella apparatus 100*a* according to the modification illustrated in FIG. 5, an outer blower 170 is installed under the ground. In addition, an air stream generated in a blower pipe 173 is supplied into the exhaust pipe 130 by the blower pipe 173 and a branched pipe 175.

The air umbrella apparatus 100*a* according to the modification may be easily installed when the ground is soft such as soil. When the ground is formed of a hard material such as precast pavers or asphalt, the air umbrella apparatus 100 according to the above-described exemplary embodiment may also be easily installed.

Meanwhile, although the air umbrella apparatus according to the exemplary embodiment of the present invention uses each of the air suction pipe and the water collection pipe in a single number, in some cases, each of the air suction pipe and the water collection pipe may be provided in a plural number.

In addition, a single air umbrella apparatus may be used, or a plurality of air umbrella apparatuses may be arranged side by side in order to expand the shield region.

As described above, the air umbrella apparatus of the present invention creates the shield region, which is protected from rain and snow, using the air curtain formed via the suction and discharge of air without a separate awning. Accordingly, the air umbrella apparatus may be used to provide a shelter for spectators when rain suddenly starts to fall when it is installed in, for example, an outdoor theater, or may prevent deep snow damage when it is installed on a vinyl greenhouse or a weak roof.

In addition, when the air umbrella apparatus of the present invention is installed in the stand of a football pitch or at an urban bus stop, people may safely avoid rain or snow without using umbrellas.

In addition, since the rain and snow stored in the water sump are clean, it may be reused in a desired place.

Figure 6:
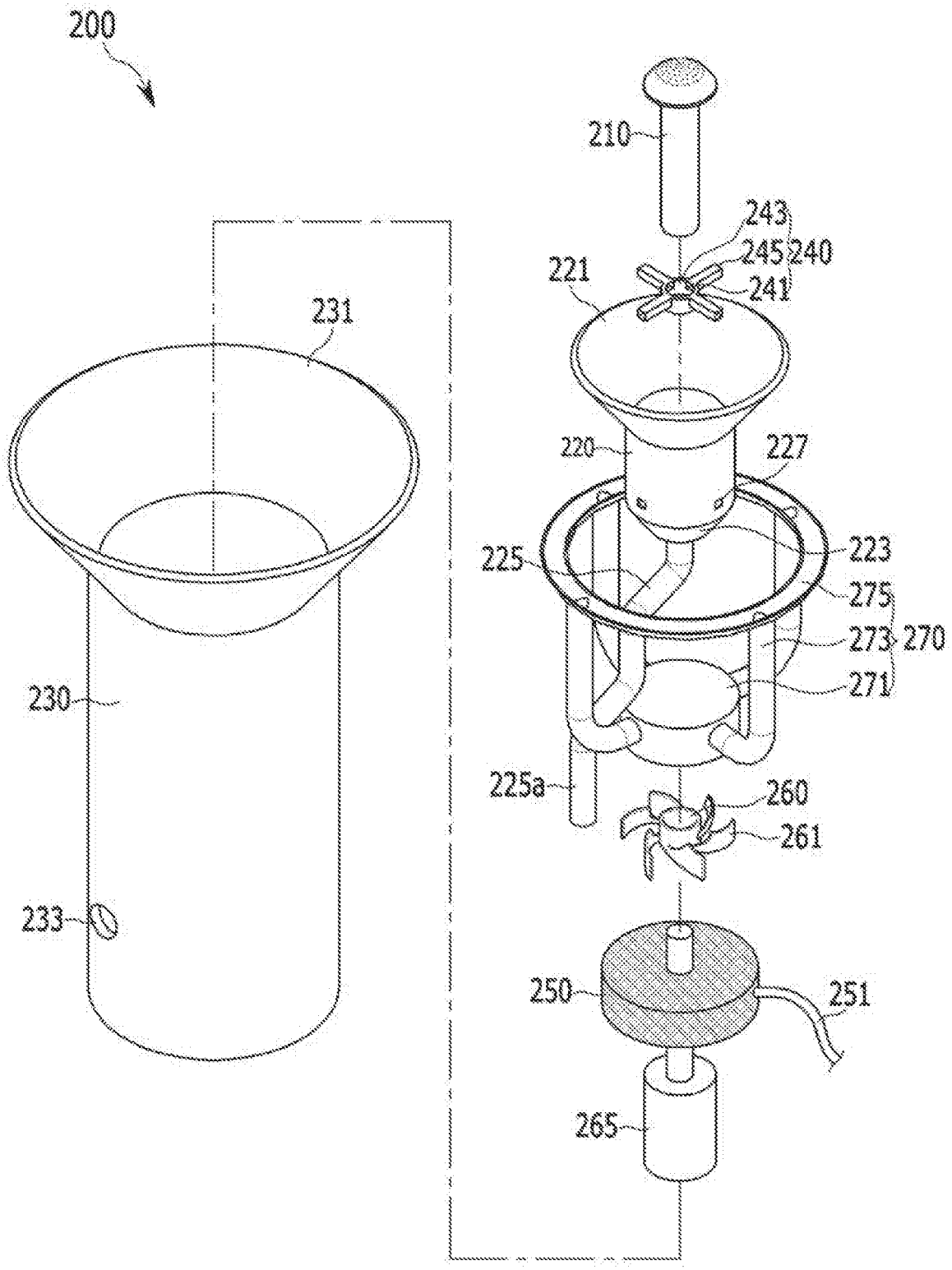
FIG. 6 is an exploded perspective view illustrating the configuration of an air umbrella apparatus according to another embodiment of the present invention.
Figure 7:
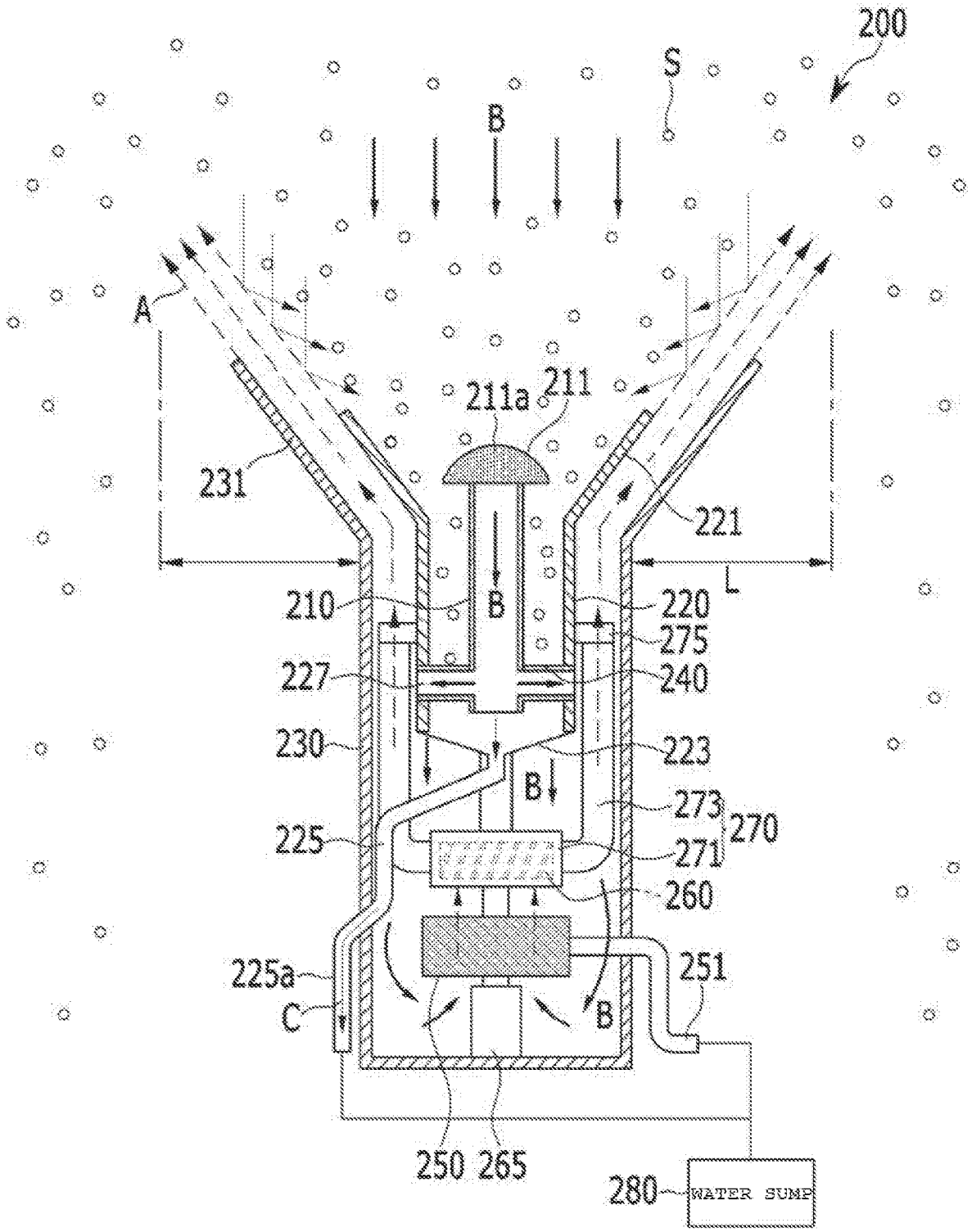
FIG. 7 is a cross-sectional view illustrating the operating procedure of the air umbrella apparatus according to the other embodiment of the present invention.

FIGS. 6 and 7 are respectively an exploded perspective view and a cross-sectional view illustrating the configuration of an air umbrella apparatus 200 according to another embodiment of the present invention.

The air umbrella apparatus 100 according to the above-described exemplary embodiment of the present invention is configured to create the shield region within a predetermined range by suctioning outside air and then discharging the air at a predetermined pressure. Although the air umbrella apparatus 200 according to the other embodiment is identical to the air umbrella apparatus 100 of the above-described exemplary embodiment in that it suctions outside air and then discharges the same outward, unlike the above-described exemplary embodiment, the air umbrella apparatus 200 discharges the suctioned outside air after removing moisture from the outside air.

In the configuration of the air umbrella apparatus 200 according to the other embodiment of the present invention, a detailed description of the same parts as those of the above-described exemplary embodiment will be omitted.

The air umbrella apparatus 200 according to the other embodiment of the present invention includes an air suction pipe 210 for introducing outside air B into the apparatus, a water collection pipe 220 for collecting, for example, falling rain and snow S, an exhaust pipe 230 for discharging inside air A outward, a communication pipe 240 accommodated in the water collection pipe 220 and coupled to the lower end of the air suction pipe 210 for moving the outside air B that has passed through the air suction pipe 210 to the space between the water collection pipe 220 and the exhaust pipe 230, a blower 260 rotatably provided in the lower region of the exhaust pipe 230 for forming an air stream so that the outside air B is introduced into the air suction pipe 210 and thereafter the inside air A is exhausted to an exhaust-guiding pipe 231, a dehumidification unit 250 for removing moisture contained in the outside air B moved into the exhaust pipe 230, and an air guiding unit 270 disposed between the blower 260 and the water collection pipe 220 for guiding the inside air A that has passed through the blower 260 to the space between the exhaust-guiding pipe 231 and a water-collection-inducing pipe 221.

Here, the term "inside air A", used in the description of the air umbrella apparatus 200 according to the other embodiment of the present invention, means the air that passes through the inside of the air umbrella apparatus 200 and is discharged outward, and the term "outside air B" means the air that is suctioned from the outside into the air umbrella apparatus 200 through the air suction pipe 210. Reference character "C" designates rainwater and melted snow collected in the water collection pipe 220. The distinction between the inside air A and the outside air B is based on whether or not the air passes through the dehumidification unit 250.

The air suction pipe 210, the water collection pipe 220, and the exhaust pipe 230 are concentrically superimposed one above another. The air suction pipe 210 is centrally disposed, the water collection pipe 220 is disposed so as to accommodate the air suction pipe 210 therein, and the exhaust pipe 230 is disposed outside the air suction pipe 210. The air suction pipe 210 and the exhaust pipe 230 are interconnected so as to enable air communication therebetween via the communication pipe 240.

The air suction pipe 210 is vertically oriented and has a predetermined height from the ground. The air suction pipe 210 is coupled at the lower end thereof to the communication pipe 240 so as to enable communication therebetween. Thereby, the outside air B introduced into a suction head 211 passes through the air suction pipe 210 to thereby move to the space between the exhaust pipe 230 and the water collection pipe 220 through the communication pipe 240. The air suction pipe 210 and the suction head 211 may be integrally formed with each other, or may be separably coupled to each other.

The water collection pipe 220 has a greater diameter than the air suction pipe 210. The water collection pipe 220 is disposed so as to accommodate the air suction pipe 210 and the communication pipe 240 therein.

The water collection pipe 220 is provided at the lower end thereof with a lower inclined portion 223, into which rainwater and melted snow C moved downward along the water collection pipe 220 is gathered. To this end, the lower inclined portion 223 is configured such that the diameter thereof gradually decreases downward. In addition, an outer drain pipe 225 is connected to the lower end of the lower inclined portion 223 so as to discharge the rainwater and melted snow C to the outside of the exhaust pipe 230.

The outer drain pipe 25 extends to the outside of the exhaust pipe 230 through a drain pipe exposing hole 233 in the exhaust pipe 230, and a sum connection pipe 225*a* extends from the outer drain pipe 225 to the ground and is connected to a water sump 280 so as to discharge the rainwater and melted snow C to the water sump 280.

Meanwhile, a plurality of air discharge holes 227 is formed in the surface of the water collection pipe 220. The air discharge holes 227 are formed at positions corresponding to respective air movement pipes 245 of the communication pipe 240. Thereby, the outside air B moved along the air movement pipes 245 may move to the space between the water collection pipe 220 and the exhaust pipe 230 through the air discharge hole 227.

The exhaust pipe 230 is disposed outside the water-collection-inducing pipe 221. The exhaust-guiding pipe 231 is disposed at the upper end of the exhaust pipe 230 and has a tapered tube shape so as to guide the discharge of air.

The exhaust pipe 230 may have a height that is greater than that of a normal adult. As illustrated in FIG. 6, the exhaust pipe 230 has a drain pipe exposing hole 233 formed in the outer surface thereof so as to expose the outer drain pipe 225 of the water collection pipe 220 to the outside.

The communication pipe 240 couples the air suction pipe 210 and the water collection pipe 220 to each other, and forms an air movement path to allow the air introduced into the air suction pipe 210 to be discharged into the space inside the exhaust pipe 230.

As illustrated in FIGS. 6 and 7, the communication pipe 240 is accommodated inside the water collection pipe 220.

The communication pipe 240 includes a communication pipe body 241 disposed coaxially with the air suction pipe 210, a suction pipe connection hole 243 formed in the communication pipe body 241 so as to allow the lower end of the air suction pipe 210 to be inserted thereinto, and the air movement pipes 245 configured to extend from the outer circumferential surface of the communication pipe body 241 at a constant angular interval to thereby be coupled to the respective air discharge holes 227 of the water collection pipe 220.

The suction pipe connection hole 243 has the same diameter as the outer diameter of the air suction pipe 210. The suction pipe connection hole 243 is formed through the communication pipe body 241. The communication pipe body 241 is disposed coaxially with the air suction pipe 210 so that the outside air B introduced into the air suction pipe 210 is introduced into the suction pipe connection hole 243. The communication pipe body 241 has a blind lower end so as to allow all of the introduced outside air B to move to the air movement pipes 245.

The air movement pipes 245 extend outward in the radial direction of the communication pipe body 241 to the inner wall surface of the water collection pipe 220. The end region of the respective air movement pipes 245 is opened and the air discharge holes 227 are located to correspond to the respective air movement pipes 245.

The dehumidification unit 250 is located in the lowermost region of the exhaust pipe 230, and removes moisture contained in the outside air B moved into the exhaust pipe 230. The dehumidification unit 250 includes a dehumidification filter or a dehumidification member capable of absorbing moisture contained in the outside air B. The outside air B moved from the bottom to the top losses moisture while moving through the dehumidification unit 250.

The moisture absorbed by the dehumidification unit 250 is drained outward through a dehumidification drain pipe 251 and moves to the water sump 280.

The blower 260 is fitted into the space between the water collection pipe 220 and the dehumidification unit 250 and applies drive force so as to forcibly move the outside air B and the inside air A. The blower 260 is rotated and creates a negative pressure to allow the outside air B to be suctioned into the air suction pipe 210. In addition, the blower 260 applies a blowing pressure to allow the inside air A that has passed through the dehumidification unit 250 to be discharged through the exhaust pipe 230.

The blower 260 has a circular shape and is provided with a plurality of rotational blades 261 in the circumferential direction thereof. The blower 260 is accommodated inside a housing 271 of the air guiding unit 270, and moves all of streams of the inside air A generated by rotation of the rotational blades 261 to the air guiding unit 270.

The blower 260 is rotated by a fan drive unit 265. As illustrated in FIG. 6, the fan drive unit 265 may be realized in the form of a drive motor 265, which is disposed on the bottom of the exhaust pipe 230. A power transmission shaft coupled to a drive shaft of the drive motor 265 penetrates the dehumidification unit 250 and is connected to a rotating shaft of the blower 260 so as to rotate the blower 260.

The fan drive unit 265 may have any of various other shapes so long as it does not interfere with the movement path of the inside air A and the outside air B.

When the blower 260 is rotated, air is introduced through the air suction pipe 210 and then is discharged outward through the exhaust pipe 230, thus forming an air curtain.

Here, an inverter (not illustrated) may be additionally coupled to the blower 260. With the coupling of the inverter (not illustrated), a user may rotate the blower 260 forward or in reverse. The blower 260 may be driven forward when it is desired to form an air umbrella for blocking rain and snow, and may be driven in reverse upon initial operation in order to discharge air from the air suction pipe 210 so as to remove foreign substances from the surface of the air suction pipe 210.

The air guiding unit 270 uniformly supplies the inside air A, which has moved to the blower 260 by way of the dehumidification unit 250, to the space between the water-collection-inducing pipe 221 and the exhaust-guiding pipe 231. The air guiding unit 270 includes the housing 271, which covers the top of the blower 260 to gather the inside air A, a plurality of air guiding pipes 273, which extends to the space between the water-collection-inducing pipe 221 and the exhaust-guiding pipe 231 so as to communicate with the housing 271, and an exhaust ring 275, which is connected to the upper ends of the air guiding pipes 273 so as to discharge the inside air A.

The housing 271 is sized so as to be accommodated inside the blower 260. The housing 271 ensures the collection of the entire inside air A generated by the rotation of the blower 260. Thereby, the air stream generated by the rotation of the blower 260 may be discharged to the space between the water-collection-inducing pipe 221 and the exhaust-guiding pipe 231 without pressure loss. Such a reduction in the pressure loss of the air stream may increase the area of the shield region L.

The air guiding pipes 273 disperse and move the inside air A collected in the housing 271 to the space between the water-collection-inducing pipe 221 and the exhaust-guiding pipe 231 so as not to interfere with the lower structure of the water collection pipe 220. The number of air guiding pipes 273 may be four as illustrated in FIG. 6, or may be five or more.

The exhaust ring 275 takes the form of a circular ring so as to communicate with the air guiding pipes 273. The reason why the exhaust ring 275 has a circular shape is to uniformly supply the inside air A into the circular space between the water-collection-inducing pipe 221 and the exhaust-guiding pipe 231 because the water-collection-inducing pipe 221 and the exhaust-guiding pipe 231 have a tapered tube shape.

The exhaust ring 275 has a semicircular cross section and the upper surface of the exhaust ring 275 is opened to enable the discharge of the inside air.

The operating procedure of the air umbrella apparatus 200 of the present invention having the above-described configuration will be described below with reference to FIGS. 6 and 7.

For installation, the user concentrically disposes the air suction pipe 210, the water collection pipe 220, and the exhaust pipe 230, which have different diameters, and couples the communication pipe 240 to the lower end of the water collection pipe 220. The position of the communication pipe 240 is adjusted such that the ends of the air movement pipes 245 correspond to the air discharge holes 227, and the lower end of the air suction pipe 210 is inserted into the suction pipe connection hole 243 such that the positions of the air suction pipe 210, the water collection pipe 220 and the communication pipe 240 are fixed. Here, the fixing between these constituent elements may be performed using fastening members such as a bolt and a nut, or may be performed by welding.

The outer drain pipe 225, which extends from the lower inclined portion 223 of the water collection pipe 220, is exposed outward through the drain pipe exposing hole 233 in the exhaust pipe 230.

The dehumidification unit 250, the blower 260, and the air guiding unit 270 are stacked one above another below the outer drain pipe 225. Here, although not illustrated in FIGS. 6 and 7, a fixing device (not illustrated) for fixing the positions of the dehumidification unit 250, the blower 260, and the air guiding unit 270 is provided to fix the positions thereof inside the exhaust pipe 230.

The fan drive unit 265 is installed so as not to interfere with the movement path of air and the aforementioned inner elements.

In addition, the water sump 280 is installed under the ground on which the air umbrella apparatus 200 is installed so that the rainwater and melted snow C introduced into the water collection pipe 220 is stored in the water sump 280. In addition, the water absorbed from the outside air B by the dehumidification unit 250 is moved to the water sump 280.

When there is no rain or snow, the state in which no power is supplied to the blower 260 is maintained. When rain or snow suddenly starts to fall, the user supplies power to the blower 260. When the blower 260 is rotated, air is suctioned into the air suction pipe 210.

As illustrated in FIG. 7, the outside air B, suctioned into suction holes 211*a* in the suction head 211, moves along the air suction pipe 210. Then, the outside air B is introduced into the communication pipe body 241, and thereafter moves to the air discharge holes 227 along the air movement pipes 245.

The outside air B is discharged from the air discharge holes 227 and moves downward along the inner wall surface of the exhaust pipe 230.

While the downwardly moved outside air B passes through the dehumidification unit 250, moisture contained in the air is removed. The inside air A, from which moisture has been removed, is collected in the housing 271 of the air guiding unit 270 by a blowing pressure, which is generated by the rotation of the rotational blades 261, and is diverged by and moves along the air guiding pipes 273. Then, the air is obliquely discharged through the exhaust ring 275 to the space between the water-collection-inducing pipe 221 and the exhaust-guiding pipe 231 to thereby be discharged to the atmosphere.

At this time, the inside air A is discharged by an amount corresponding to the thickness of the space between the exhaust-guiding pipe 231 and the water-collection-inducing pipe 221, thereby forming an air curtain. The rain or snow, which falls to the air curtain, is guided so as to move to the water collection pipe 220 by the pressure of the air curtain.

That is, a low-pressure suction air field is created at the upper side of the water-collection-inducing pipe 221 by the amount of air introduced through the air suction pipe. Thereby, when the rain or snow reaches the inside of the air curtain, it changes direction and moves to the inside of the low-pressure suction air field created at the upper side of the water-collection-inducing pipe 221, thereby being guided to the water collecting pipe 220 by the weight thereof. As a result, the shield region L, which is protected from exposure to rain or snow, is formed below the space that corresponds to the periphery of the air curtain, which is formed at the upper side of the exhaust pipe 230.

In this way, the shield region L, which is protected from rain or snow, is formed below the exhaust-guiding pipe 231 by which the air curtain is formed. When rain or snow falls, a pedestrian who stands below the exhaust-guiding pipe 131 may avoid rain or snow.

At this time, when the length of the air curtain is increased by increasing or reducing the rotational speed of the blower 260, the area of the shield region L may be increased. In addition, the rotational speed of the blower 260 may be increased or reduced according to the amount of rain or snow.

Meanwhile, the rain or snow introduced into the water collection pipe 220 moves downward, and thereafter is stored in the water sump 280.

The air umbrella apparatus according to the other embodiment of the present invention includes the dehumidification unit therein, unlike the above-described embodiment. Thus, when the air umbrella apparatus of the present invention is operated in the state in which the humidity of the atmosphere is high and there is fog before and after rain falls, the air umbrella apparatus repeatedly suctions wet outside air and discharges dry inside air, from which moisture has been removed, to the atmosphere, which may improve visibility problems caused by fog within a given space and may create a pleasant atmosphere.

As is apparent from the above description, an air umbrella apparatus of the present invention forms a shield region, which is protected from rain and snow, using an air curtain, which is formed by the suction and discharge of air, without a separate awning. Thereby, the air umbrella apparatus may be used to provide a shelter for spectators when rain suddenly starts to fall when it is installed in, for example, an outdoor theater, or may prevent deep snow damage when it is installed on a vinyl greenhouse or a weak roof.

In addition, when the air umbrella apparatus of the present invention is installed in the stand of a football pitch or at an urban bus stop, people may safely avoid rain or snow without using umbrellas.

In addition, since the rain and snow stored in the water sump are clean, it may be reused in a desired place.

In addition, when an air umbrella apparatus according to another embodiment of the present invention is operated in the state in which the humidity of the atmosphere is high and there is fog before and after rain falls, the air umbrella apparatus repeatedly suctions wet outside air and discharges dry inside air, from which moisture has been removed, to the atmosphere, which may improve visibility problems caused by fog within a given space and may create a pleasant atmosphere.

The embodiments of the air umbrella apparatus of the present invention described above are merely given by way of example, and various modifications and substitutions related to the above description are possible by those skilled in the art without departing from the scope and spirit of the disclosure. Accordingly, the disclosed embodiments are provided for the purpose of description and are not intended to limit the technical scope of the disclosure, and the technical scope of the disclosure is not limited by the embodiments. The range of the disclosure should be interpreted based on the following claims, and all technical ideas that fall within the range equivalent to the claims should be understood as belonging to the scope of the disclosure.

What is claimed is:

1. An air umbrella apparatus comprising:

an air suction pipe vertically disposed on a ground and having an air suction hole formed in an upper end thereof, wherein the air suction pipe includes a semi-spherical suction head coupled to the upper end thereof, and the air suction hole, into which the air is suctioned, is formed in a plural number on a surface of the suction head;

a water collection pipe disposed concentrically with the air suction pipe so as to accommodate the air suction pipe therein, a water-collection-inducing pipe being coupled to an upper end of the water collection pipe so as to guide rain or snow downward;

an exhaust pipe disposed concentrically with the water collection pipe so as to accommodate the water collection pipe therein, an exhaust-guiding pipe being coupled to an upper end of the exhaust pipe so as to guide air outward, wherein each of the water-collection-inducing pipe and the exhaust-guiding pipe takes the form of a tapered tube, a diameter of which gradually increases upward;

a communication pipe coupled to lower ends of the air suction pipe, the water collection pipe, and the exhaust pipe so as to communicate the air suction pipe and the exhaust pipe with each other, wherein the communication pipe is provided at a lower side thereof with a water sump in which rainwater and melted snow moved downward through the water collection pipe is stored; and a blower disposed between the exhaust pipe and the water collection pipe so as to introduce the air through the air suction pipe and exhaust the air through the exhaust pipe, wherein the air exhausted through the exhaust-guiding pipe forms an air curtain having a predetermined area at an upper side of the exhaust-guiding pipe, thereby preventing the rain and snow from falling from the exhaust-guiding pipe.

2. The air umbrella apparatus according to claim 1, wherein the water-collection-inducing pipe includes a hot wire heater provided on a surface thereof.

3. The air umbrella apparatus according to claim 2, wherein the exhaust-guiding pipe is longer than the water collection pipe, and wherein the exhaust-guiding pipe is configured so as to be foldable toward a center thereof.

4. The air umbrella apparatus according to claim 3, further comprising an inverter coupled to the blower so as to drive the blower forward or in reverse.

5. An air umbrella apparatus comprising:

an air suction pipe vertically disposed on a ground and having a suction hole formed in an upper end thereof, into which outside air is suctioned;

a water collection pipe disposed concentrically with the air suction pipe so as to accommodate the air suction pipe therein, a water-collection-inducing pipe being coupled to an upper end of the water collection pipe so as to guide rain or snow inward;

an exhaust pipe disposed concentrically with the water collection pipe so as to accommodate the water collection pipe therein, an exhaust-guiding pipe being coupled to an upper end of the exhaust pipe so as to guide inside air outward;

a communication pipe accommodated in the water collection pipe and coupled to a lower end of the air suction pipe so as to move the outside air that has passed through the air suction pipe to a space between the water collection pipe and the exhaust pipe;

a blower rotatably provided at a lower side of the exhaust pipe so as to form an air stream so that the outside air is introduced through the air suction pipe, and thereafter the inside air is exhausted through the exhaust-guiding pipe;

an air guiding unit disposed between the blower and the water collection pipe and configured to guide the inside air that has passed through the blower to a space between the exhaust-guiding pipe and the water-collection-inducing pipe; and a dehumidification unit provided between a bottom surface of the exhaust pipe and the blower and configured to remove moisture contained in the outside air introduced into the exhaust pipe, wherein the inside air exhausted through the exhaust-guiding pipe forms an air curtain having a predetermined area at an upper side of the exhaust-guiding pipe, thereby preventing the rain and snow from falling from the exhaust-guiding pipe.

6. The air umbrella apparatus according to claim 5, wherein the air guiding unit includes:

a housing configured to cover a top of the blower;

a plurality of air guiding pipes disposed in an upper region of the housing symmetrically from the housing and configured so as to extend to the space between the water-collection-inducing pipe and the exhaust-guiding pipe; and an exhaust ring coupled so as to communicate with the air guiding pipes and disposed in a ring shape between the water-collection-inducing pipe and the exhaust-guiding pipe so as to discharge the inside air moved along the air guiding pipes.

7. The air umbrella apparatus according to claim 6, further comprising a water sump connection pipe configured to extend from a lower end of the water collection pipe to an outside of the exhaust pipe so as to discharge the rain or water outward.

8. The air umbrella apparatus according to claim 7, further comprising a dehumidification drain pipe configured to extend outward from the dehumidification unit so as to outwardly discharge water absorbed and condensed by the dehumidification unit.

* * * * *